US007189936B2

(12) United States Patent
Gray, Jr.

(10) Patent No.: US 7,189,936 B2
(45) Date of Patent: Mar. 13, 2007

(54) CONTROL DEVICE FOR WALL-MOUNTED ROCKER SWITCH

(75) Inventor: Robert C. Gray, Jr., Louisville, KY (US)

(73) Assignee: DES AutoChron, LLC, Louisville, KY (US)

( * ) Notice: Subject to any disclaimer, the term of this patent is extended or adjusted under 35 U.S.C. 154(b) by 149 days.

(21) Appl. No.: 10/982,858

(22) Filed: Oct. 15, 2004

(65) Prior Publication Data

US 2005/0082150 A1 Apr. 21, 2005

Related U.S. Application Data

(60) Provisional application No. 60/513,269, filed on Oct. 17, 2003.

(51) Int. Cl.
*H01H 3/00* (2006.01)

(52) U.S. Cl. ..... 200/331

(58) Field of Classification Search ..... 200/11 R, 200/17 R, 19 R, 20, 21, 28, 30 R, 19 A, 200/33 R, 35 R, 36, 38 R–38 E, 39 R, 40, 200/50.01, 52 R, 500–502, 330, 331; 307/112, 307/116, 126, 119, 122, 134, 139–141, 141.4, 307/149, 150; 315/149, 159, 362
See application file for complete search history.

(56) References Cited

U.S. PATENT DOCUMENTS 2,515,932 A 7/1950 Stang et al.
2,524,215 A 10/1950 Wegehoft
3,171,920 A 3/1965 Klein et al.
3,179,396 A 4/1965 Bracken
3,818,156 A 6/1974 Augustyniak
3,985,982 A 10/1976 Schneidinger
4,508,943 A 4/1985 Pfeiffer et al.
4,835,413 A 5/1989 Nilssen
4,912,376 A 3/1990 Strick
5,397,869 A 3/1995 Huen
5,577,602 A * 11/1996 Conner et al. ..... 200/331
5,719,362 A 2/1998 Gray, Jr.
5,875,886 A * 3/1999 Elster ..... 200/331
5,934,452 A * 8/1999 Sanguedolce ..... 200/331
5,955,796 A * 9/1999 Nilssen ..... 307/140

* cited by examiner

*Primary Examiner*—Michael A. Friedhofer
(74) *Attorney, Agent, or Firm*—Stites & Harbison, PLLC; Mandy W. Decker; David W. Nagle, Jr.

(57) ABSTRACT

A control device that can be mounted against the face plate of a rocker switch automatically operates the rocker switch in accordance with at least one predetermined program. The device also allows the predetermined program to be overridden to manipulate the rocker switch as desired without removing of the device. The device includes a controller for activating the device according to parameters of the predetermined program; a power component that is responsive to the controller; and a plate that is moved by the power component with respect to the switch. The plate has a finger adapted to abut the rocker. When the finger abuts of a first portion of the rocker, the switch is placed in an opened position, and when the finger abuts a second portion of the rocker, the switch is placed in a closed position.

14 Claims, 5 Drawing Sheets

CONTROL DEVICE FOR WALL-MOUNTED ROCKER SWITCH

CROSS REFERENCES TO RELATED APPLICATIONS

This application claims priority from U.S. Provisional Application Ser. No. 60/513,269 filed Oct. 17, 2003, the entire disclosure of which is incorporated herein by this reference.

FIELD OF THE INVENTION

The present invention relates to a control device, and, more particularly, to a control device that can be mounted against the face plate of a wall-mounted rocker switch plate and automatically operate the rocker switch in accordance with a predetermined program.

BACKGROUND OF THE INVENTION

While there are numerous control devices for controlling individual lights and appliances in accordance with predetermined programs, little progress has been made to control the turning "on and off" of circuitry connected to wall-mounted switches. Many of those that have been developed appear to be either cumbersome in operation or necessarily "hardwired" to the existing circuitry connected to the switch. Such prior art control devices are inconvenient when the user wants to operate the switch manually because access to the switch requires complete removal of the timer control device.

One control device that addressed many of the drawbacks of early attempts at providing for a switch controlling device is described in U.S. Pat. No. 5,719,362, which is incorporated herein by reference. The '362 patent discloses a timer controller device that can be mounted against the face plate of a wall-mounted toggle switch without additional fasteners or accessories and allows for the manual or automatic manipulation of the toggle switch without removal of the timer control device. However, the timer control device of the '362 patent is designed specifically for a toggle switch.

Accordingly, there remains a need in the art for a timer control device which satisfactorily addresses the shortcomings of prior art devices.

SUMMARY OF THE INVENTION

The present invention meets the above identified needs, and others, by providing a control device for automatically operating a rocker switch in accordance with one or more predetermined programs, which device also allows for the manipulation of the rocker switch without removal of the control device.

An exemplary control device has a first housing, including a control panel and enclosing power components and control circuitry for operating the rocker switch, and a second housing, defining compartments for holding batteries that supply electromotive energy to the power components. The power components include a motor, which is operatively connected by a series of gears to a cam operating arm that controls the upward and downward movement of a sliding plate.

The cam arm is positioned for rotational movement within an elliptical opening defined by the sliding plate. Specifically, the cam arm engages an elliptical edge of the opening, causing the sliding plate to move either upward or downward. The sliding plate includes an integral finger positioned to abut the surface of a rocker of the rocker switch. As the sliding plate is moved, the integral finger moves upward and downward along the rocker, thereby manipulating the position of the rocker and moving the rocker switch between an opened or closed position, i.e., "off" or "on."

The exemplary control device is operated using the control panel, which includes a variety of keys for setting the current day and time and for entering parameters of programs to be saved by the device. Specifically, the exemplary control panel includes keys that are electronically connected to a clock for entering the current day and time into the exemplary device. Additionally, the control panel includes keys that are electronically connected to a rewritable electronic data storage unit, which keys are used to enter the parameters of the programs to be saved by the data storage unit.

The clock and data storage unit are in electronic communication with one another to facilitate the correct and timely activation of each saved program. The data storage unit is in further electronic communication with a controller. The motor is responsive to data storage unit; as such, when it is time for the rocker switch to be operated according to the parameters of a saved program, the data storage unit signals the controller, which activates the motor. The motor remains activated until the cam arm has rotated sufficiently to cause the sliding plate with integral finger to move against the rocker such that it operates the rocker switch.

When desirable, the saved programs may be overridden. In this regard, on and off keys are provided, which are electronically connected directly to the controller. By pressing either the on key or the off key, a user may directly signal the controller to activate the motor such that the rocker switch is manipulated as desired.

DESCRIPTION OF THE INVENTION

The present invention is a control device that can be mounted against the face plate of a rocker switch for automatically operating the rocker switch in accordance with at least one predetermined program, which device also allows for the manipulation of the rocker switch without removal of the control device.

Figure 1:
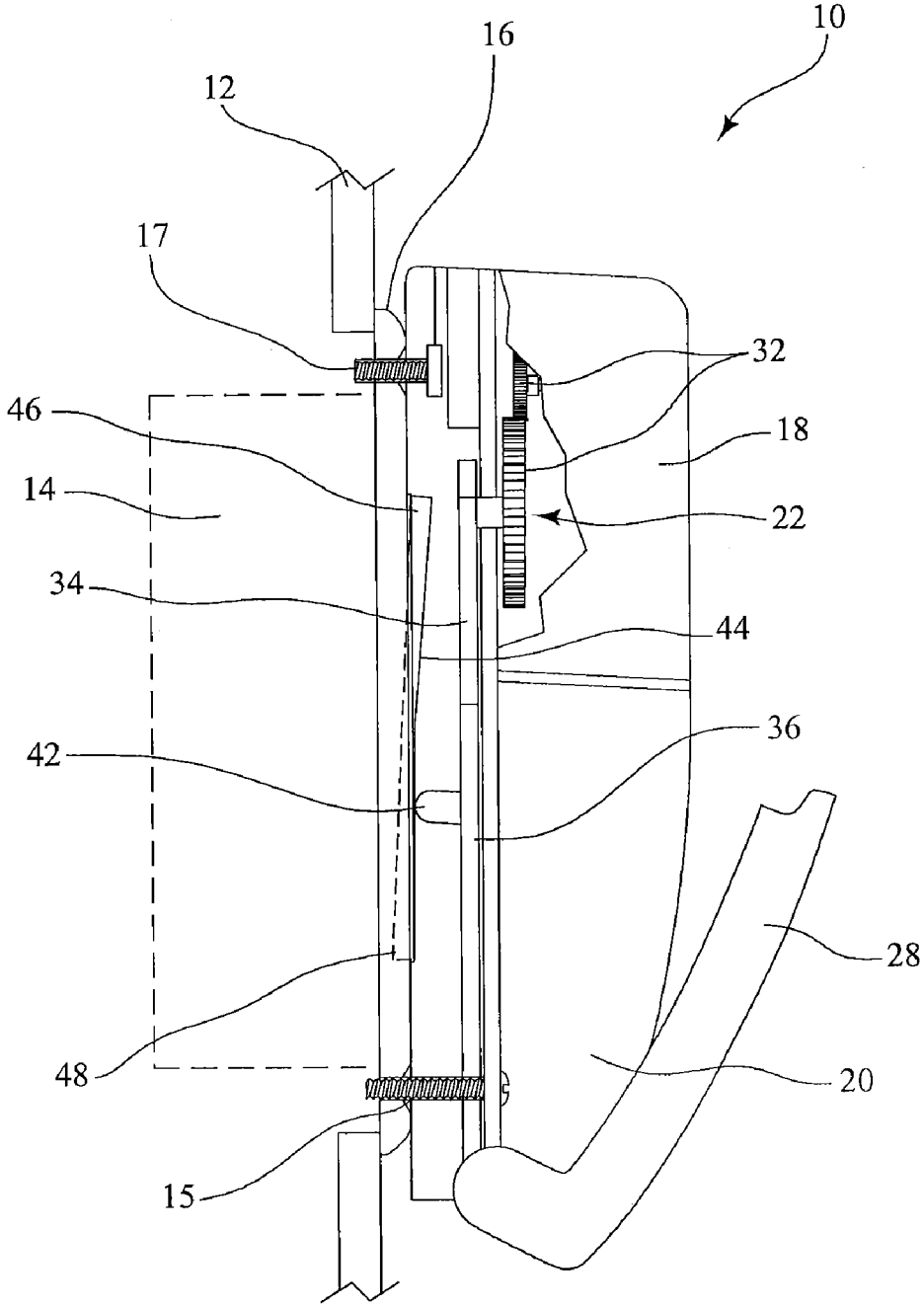
FIG. 1 is a side sectional view of a control device made in accordance with the present invention.
Figure 2:
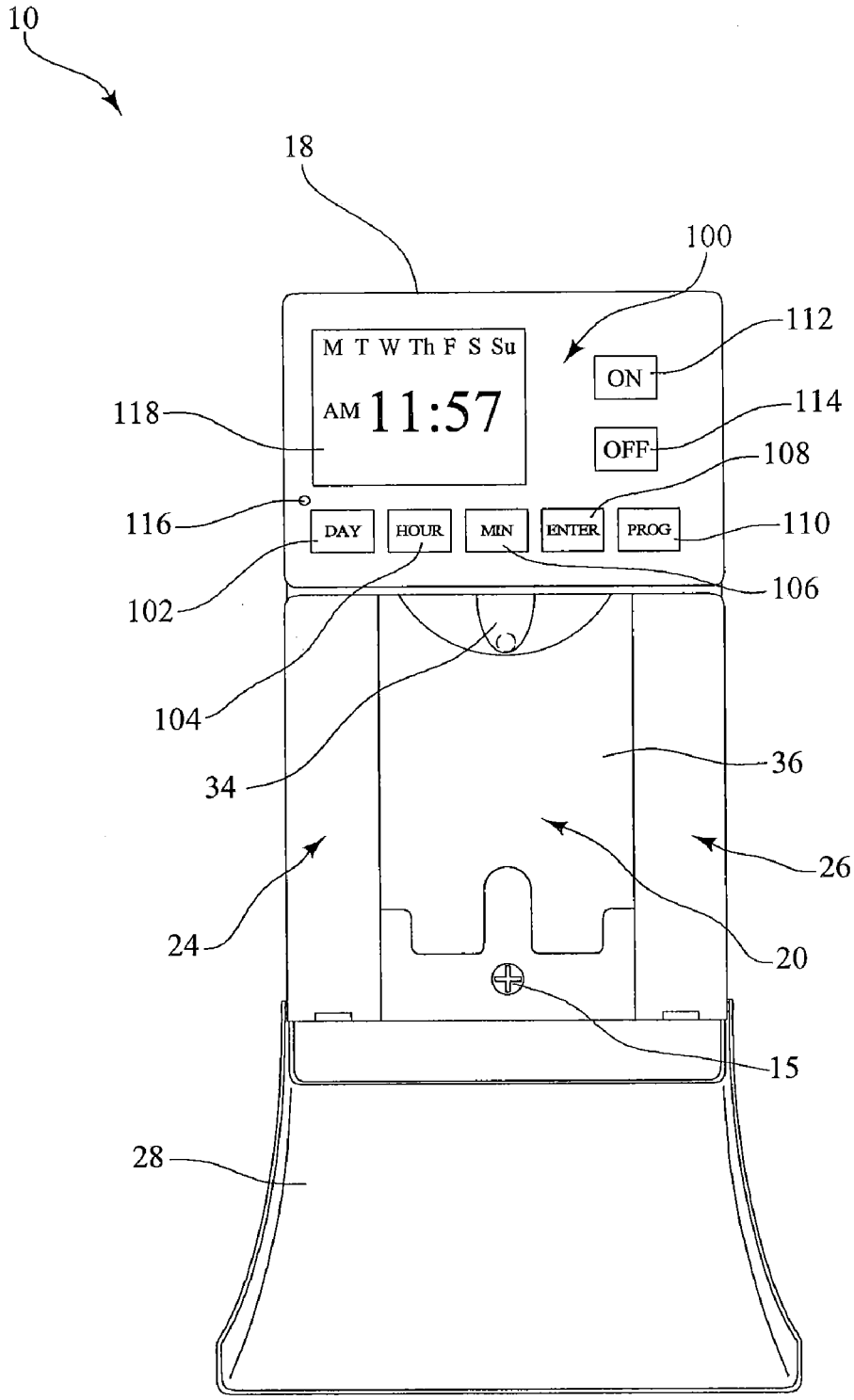
FIG. 2 is a front view of the control device of FIG. 1.
Figure 3:
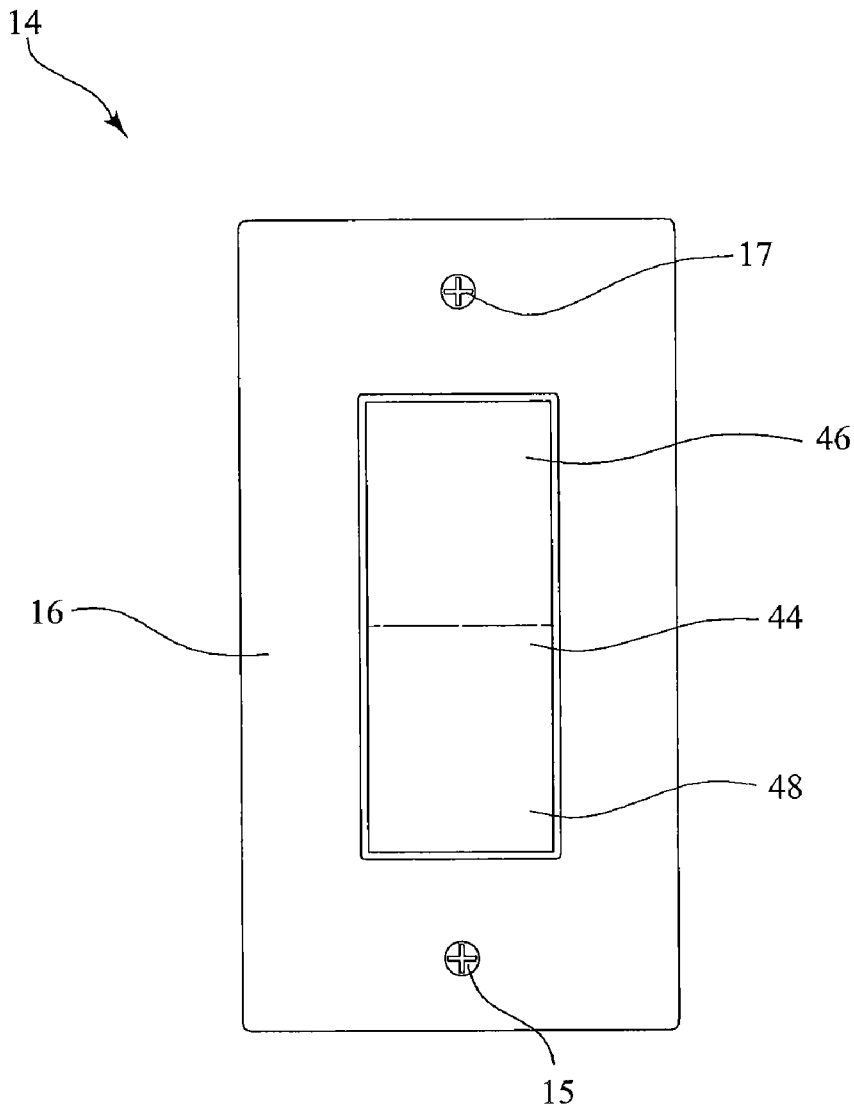
FIG. 3 is a plan view of a rocker switch and associated face plate.

With reference to FIGS. 1 through 3, an exemplary embodiment of the control device 10 is designed to be mounted to a wall 12 adjacent the rocker switch 14 or to a face plate 16 of the rocker switch 14, such as the one depicted in FIG. 3. For example, the device 10 may be secured over the rocker switch 14 by removing a bottom screw 15 from the face plate 16, placing the device 10 directly over the face plate 16 allowing it to engage and "hang" on a top screw 17 of the face plate 16. A hole defined through the device 10 is aligned with a hole defined by the face plate 16, which was exposed when the bottom screw 15 was removed. Finally, the bottom screw 15, or a longer screw having substantially the same diameter as the bottom screw 15, is fed through the two holes to secure the device 10 to the face plate 16.

The exemplary control device 10 includes a first housing 18 and a second housing 20. The first housing 18 includes a control panel 100, best shown in FIG. 2, and encloses power components 22 and control circuitry (not shown) designed to operate the rocker switch 14. The second housing 20 defines compartments 24, 26 for holding one or more batteries (not shown), which supply electromotive energy to the power components 22. A cover 28 is pivotally mounted to the second housing 20 and may be opened to access the battery compartments 24, 26.

Figure 4A:
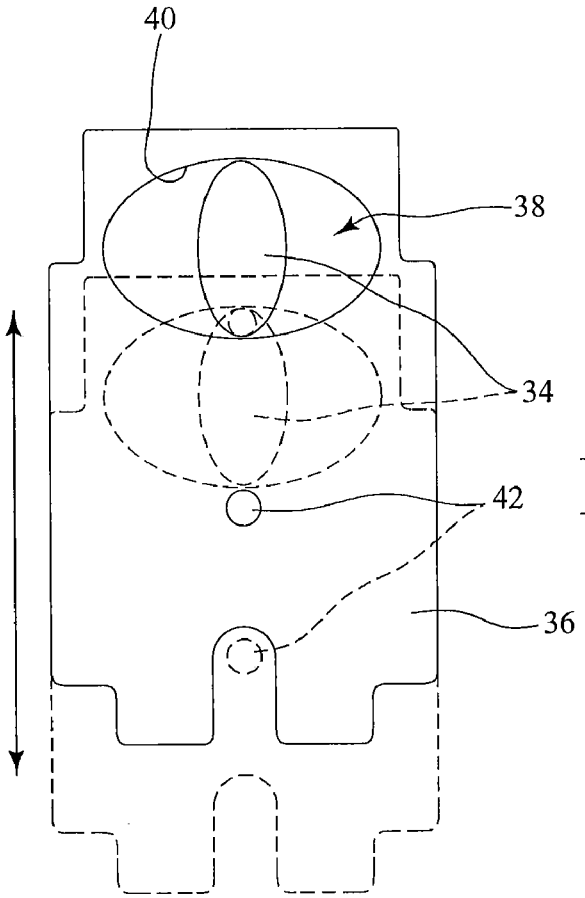
FIG. 4A is a plan view of a sliding plate of the control device of FIG. 1, shown in its uppermost position and shown in phantom in its lowermost position.
Figure 4B:
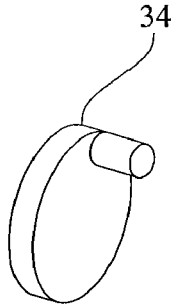
FIG. 4B is a perspective view of a cam operating arm of the control device of FIG. 1.

The power components 22 of the exemplary control device 10 include a motor 30 (shown in FIG. 5), which is operatively connected by a series of gears 32 to a cam operating arm 34 that controls the upward and downward movement of a sliding plate 36. Referring now to FIGS. 1, 4A, and 4B, the cam arm 34 is positioned for rotational movement within an elliptical opening 38 defined by the sliding plate 36. Specifically, the cam arm 34 engages an elliptical edge 40 of the opening 34, causing the sliding plate 36 to move either upward or downward. The sliding plate 36 includes an integral finger 42 positioned to abut the surface of and to manipulate a rocker 44 of the rocker switch 14. The integral finger 42 may be constructed such that it may extend or withdraw relative to the surface of plate 36 to account for any variation in depth of the rocker 44 of a particular rocker switch 14. For example, the finger 42 could be constructed from a flexible material, it could be spring loaded or it take the form of a flexible spring or living hinge. In any event, as the sliding plate 36 is moved upward and downward by the rotating cam arm 34, the integral finger 42 moves upward and downward along the rocker 44, thereby manipulating the position of the rocker 44.

For example, and with reference to FIGS. 1 and 4A, when the sliding plate 36 is in its uppermost position (shown in FIG. 4A in solid lines), the finger 42 abuts and depresses a top portion 46 of the rocker 44. Similarly, when the sliding plate 36 is moved into its lowermost position (shown in phantom in FIG. 4A), the finger 42 abuts and depresses a lower portion 48 of the rocker 44. In this manner, the power components 22 of the exemplary control device 10 may be used to operate the rocker switch 14, moving it into an opened or closed position, i.e., "off" or "on."

Figure 5:
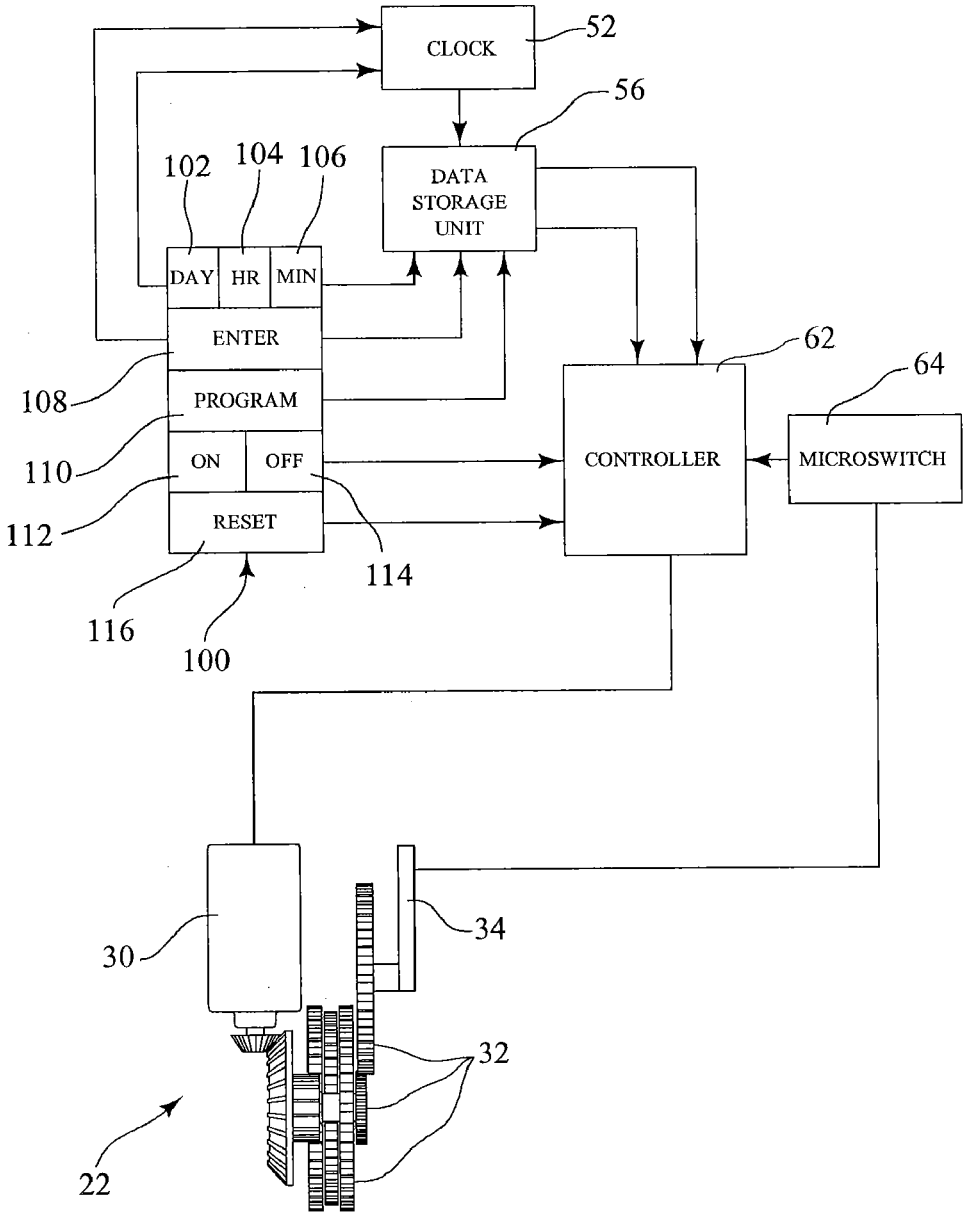
FIG. 5 is a block diagram of the control circuitry coupled with a schematic of the power components of the control device of FIG. 1.

To describe the operating sequence of the exemplary control device 10, reference is now made to FIGS. 2 and 5. The control panel 100 is used for entering the current day and time and one or more programs into the device 10. The exemplary control panel 100 includes a day key 102, an hour key 104, a minute key 106, an enter key 108, a program key 110, an on key 112, an off key 114, a reset button 116, and a display 118.

As best shown in FIG. 5, the day 102, hour 104, minute 106 and enter 108 keys are electronically connected to a clock 52 for entering the current day and time into the exemplary device 10. Additionally, the day 102, hour 104, minute 106, enter 108 and program 110 keys are electronically connected to a rewritable electronic data storage unit 62, such as a programmable integrated circuit (PIC), for storing the programs. The clock 52 and data storage unit 56 are in electronic communication with one another to facilitate the correct and timely activation of each saved program.

The data storage unit 56 is in further electronic communication with a controller 62. When it is time for the rocker switch 14 to be opened according to the parameters of a saved program, the data storage unit 56 signals the controller 62, which activates the motor 30. The motor 30 remains activated until the cam arm 34 and the series of gears 34 have rotated sufficiently to cause the sliding plate 36 with integral finger 42 to move against the rocker 44 such that it opens the rocker switch 14. When the cam arm 34 and the series of gears 32 have so rotated, a microswitch 64 is triggered, which microswitch 64 provides a signal to the controller 62 and the motor 30 is deactivated. When it is time for the rocker switch 14 to be closed according to the parameters of a saved program, the data storage unit 56 again signals the controller 62, which again actives the motor 30. This time the motor 30 is activated to cause the sliding plate 36 to move in the opposite direction, thus closing the rocker switch 14, and the controller 62 is again signaled via the microswitch 64 and the motor 30 again deactivated.

When desirable, the saved program or programs may be overridden. In this regard, the on 112 and off 114 keys are electronically connected directly to the controller 62. By pressing either the on key 112 or the off 114 key, a user may directly signal the controller 62 to activate the motor 30 until the cam arm 34 has rotated sufficiently to operate the rocker switch 14 as desired. In this regard, the rocker switch 14 may be manipulated as desired without removing the exemplary device 10 and without specifically programming the device 10.

In any event, to program the exemplary device 10 to operate the rocker switch 14 in a predetermined manner, a user may begin by setting the current day and time. First, the day key 102 is pressed until the current day of the week appears on the display 118. For example, M, T, W, Th, F, S, or Su will appear for Monday, Tuesday, Wednesday, Thursday, Friday, Saturday or Sunday, respectively. Next, the hour key 104 is pressed until the current hour of the day appears on the display 118. Next, the minute key 106 is pressed until the current minutes for the hour appear on the display 118. Finally, the enter key 108 is pressed indicating that the current day and time have been selected and the exemplary device 10 is ready to receive programs.

To enter a program into the exemplary device 10 the user may conduct the following steps: pressing the program key 110; setting the day and time for the device 10 to move the rocker switch 14 into the closed ("on") position; pressing the enter key 108; setting the day and time for the device 10 to move the rocker switch 14 into the opened ("off") position; and pressing the program key 110 again.

To set the day and time for the device 10 to move the rocker switch 14 into the closed ("on") position, the user may press the day key 102 to select the day or days on which the program will operate; a selected day will appear on the display 118. For example, if the user wishes the program to operate on each of the seven days of the week, the user will press the day key 102 until M, T, W, Th, F, S, and Su all appear on the display 118. Next, the user will select the time of day for the program to operate by pressing the hour key 104 and the minute key 106 until the desired time appears on the display 118. The user will then press the enter key 108 before moving to the next step.

To set the day and time for the device 10 to move the rocker switch 14 into the opened ("off") position, the user will again press the day 102, hour 104 and minute 106 keys until the desired day(s) and time appears on the display 118. To finish entering the program, the user will press the program key 110.

A plurality of programs may be saved by the exemplary device 10, each of which may be assigned a particular name, for example, programs 1 through 9. In this regard, the exemplary device 10 may activate the rocker switch 14 multiple times within a single day by setting multiple programs affecting that day, which ability is illustrated by the following prophetic, specific and non-limiting example.

EXAMPLE

A user enters three programs into the exemplary device 10 having the following parameters:

| | | |
|---|---|---|
| Program 1 | | |
| On | M W F | 8:30 AM |
| Off | M W F | 10:00 AM |
| Program 2 | | |
| On | M T W Th F | 11:00 AM |
| Off | M T W Th F | 2:30 PM |
| Program 3 | | |
| On | T Th S Su | 5:00 PM |
| Off | T Th S Su | 8:30 PM |

When programs 1, 2 and 3 are simultaneously working to activate the rocker switch 14 it will turn on and off in the following sequence:

| | | |
|---|---|---|
| Monday | On (Program 1) | 8:30 AM |
| | Off (Program 1) | 10:00 AM |
| | On (Program 2) | 11:00 AM |
| | Off (Program 2) | 2:30 PM |
| Tuesday | On (Program 2) | 11:00 AM |
| | Off (Program 2) | 2:30 PM |
| | On (Program 3) | 5:00 PM |
| | Off (Program 3) | 8:30 PM |
| Wednesday | On (Program 1) | 8:30 AM |
| | Off (Program 1) | 10:00 AM |
| | On (Program 2) | 11:00 AM |
| | Off (Program 2) | 2:30 PM |
| Thursday | On (Program 2) | 11:00 AM |
| | Off (Program 2) | 2:30 PM |
| | On (Program 3) | 5:00 PM |
| | Off (Program 3) | 8:30 PM |
| Friday | On (Program 1) | 8:30 AM |
| | Off (Program 1) | 10:00 AM |
| | On (Program 2) | 11:00 AM |
| | Off (Program 2) | 2:30 PM |
| Saturday | On (Program 3) | 5:00 PM |
| | Off (Program 3) | 8:30 PM |
| Sunday | On (Program 3) | 5:00 PM |
| | Off (Program 3) | 8:30 PM |

Once a program has been saved by the exemplary device 10, its parameters may be reviewed by starting with the current day and time appearing of the display 118, pressing the program key 110, and pressing the enter key 108. The user may advance to the desired program by repeatedly pressing the enter key 108; each time the enter key 108 is pressed, the parameters of a particular saved program will appear on the display 118. To return the display to the current day and time, the user presses the program key 110.

A particular program may be cleared by starting with the current day and time appearing of the display 118, pressing the program key 110, advancing to the desired program by repeatedly pressing the enter key 108, and pressing the day key 102 until the parameters of the program disappear from the display 118. To return the display to the current day and time, the user presses the program key 110.

To reset the exemplary device 10, clearing all saved programs and the current day and time, a reset button 116 is provided. As best shown in FIG. 2, the exemplary reset button 116 may be accessed through an aperture defined by the first housing 18 using, for example, a pointed object such as a straightened paperclip.

It will be obvious to those skilled in the art that further modifications may be made to the embodiments described herein without departing from the spirit and scope of the present invention.

What is claimed is:

1. A control device for automatically moving a rocker switch between an opened and a closed position in accordance with at least one predetermined program, comprising:

a controller for activating said device according to parameters of the predetermined program;

a power component being responsive to said controller;

a plate adapted for slidable movement with respect to the switch and having a finger extending from a surface thereof adapted to abut a rocker of the switch, the switch being in the opened position when said finger abuts a first portion of said rocker and the switch being in the closed position when said finger abuts a second portion of said rocker; and a cam operating arm mounted for rotation within a substantially elliptical opening defined by said plate, said cam operating arm engaging an edge of the substantially elliptical opening, such that as the cam operating arm is rotated by the power component, the plate is moved upward or downward, with said finger transitioning the rocker switch between the opened and closed positions.

2. The device of claim 1, in which the power component includes a motor for rotating the cam operating arm.

3. The device of claim 2, wherein the cam operating arm is operably connected to said motor by a series of gears.

4. The device of claim 1, wherein electromotive energy is supplied to said power component by at least one battery.

5. The device of claim 1, wherein said finger extends or withdraws relative to the surface of said plate to account for any variation in depth of the rocker of the switch.

6. The device of claim 5, wherein said finger is spring loaded.

7. The device of claim 1, and further comprising a data storage unit for storing the parameters of the predetermined program, said data storage unit being in electronic communication with said controller.

8. The device of claim 7, and further comprising a clock being in electronic communication with said data storage unit to timely provide said controller with the parameters of the predetermined program.

9. The device of claim 7, and further comprising a control panel being in electronic communication with said clock and said data storage unit to set time and enter parameters of the predetermined program.

10. The device of claim 1, wherein said controller may be directly signaled to activate said device, thereby overriding the predetermined program.

11. The device of claim 10, wherein said controller may be directly signaled using at least one key in electronic communication with said controller.

12. A control device for automatically moving a rocker-operated switch between an opened position and a closed position in accordance with at least one predetermined program, comprising:

a data storage unit for storing parameters of the predetermined program;

a controller for activating said device according to parameters of the predetermined program;

a clock to facilitate timely activation of said device according to parameters of the predetermined program;

a power component being responsive to said controller;

a plate adapted for slidable movement with respect to the switch and having a finger extending from a surface thereof adapted to abut the rocker of the switch, the switch being in the opened position when said finger abuts a first portion of said rocker and the switch being in the closed position when said finger abuts a second portion of said rocker; and a cam operating arm mounted for rotation within a substantially elliptical opening defined by said plate, said cam operating arm engaging an edge of the substantially elliptical opening, such that as the cam operating arm is rotated by the power component, the plate is moved upward or downward, with said finger transitioning the rocker switch between the opened and closed positions.

13. The device of claim 12, in which the power component includes a motor for rotating the cam operating arm.

14. The device of claim 13, wherein the cam operating arm is operably connected to said motor by a series of gears.

* * * * *